US008221955B2

(12) United States Patent
Victor et al.

(10) Patent No.: US 8,221,955 B2
(45) Date of Patent: Jul. 17, 2012

(54) METHODS OF PRODUCING INK TONERS AND INK COMPOSITIONS INCLUDING INK TONERS

(75) Inventors: Gal Victor, Rehovot Rehovot (IL); Dan Scheffer, Rochester, MN (US); Galia Golodetz, Rehovot Rehovot, IL (US); Jose Kuperwasser, Ashdod, IL (US); Natalia Katz, Ashdod, IL (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 400 days.

(21) Appl. No.: 12/375,002

(22) PCT Filed: Jul. 25, 2006

(86) PCT No.: PCT/US2006/028758

§ 371 (c)(1), (2), (4) Date: Nov. 4, 2009

(87) PCT Pub. No.: WO2008/013522

PCT Pub. Date: Jan. 31, 2008

(65) Prior Publication Data

US 2010/0062360 A1 Mar. 11, 2010

(51) Int. Cl.
*G03G 9/12* (2006.01)

(52) U.S. Cl. ..... 430/137.22; 430/115; 430/116; 430/137.19

(58) Field of Classification Search ..... 430/115, 430/116, 137.22, 137.19
See application file for complete search history.

(56) References Cited

U.S. PATENT DOCUMENTS

| | | | | |
|---|---|---|---|---|
| 5,330,868 | A * | 7/1994 | Santilli et al. | 430/114 |
| 6,117,606 | A | 9/2000 | Macholdt et al. | |
| 2005/0037059 | A1 * | 2/2005 | Miller | 424/448 |
| 2006/0027139 | A1 * | 2/2006 | Bujard et al. | 106/31.65 |
| 2007/0020545 | A1 * | 1/2007 | Bossidan et al. | 430/108.21 |

FOREIGN PATENT DOCUMENTS

| | | | |
|---|---|---|---|
| EP | 0424093 | | 3/1995 |
| EP | 1204005 | | 5/2002 |
| JP | 2004-61813 | * | 2/2004 |
| JP | 2004-61818 | * | 2/2004 |

OTHER PUBLICATIONS

Translation of JP 2004-61813 published Feb. 2004.*
Translation of JP 2004-61818 published Feb. 2004.*

* cited by examiner

*Primary Examiner* — Peter Vajda

(57) ABSTRACT

Methods of making ink toners for use in electrostatic imaging are disclosed.

17 Claims, 2 Drawing Sheets

METHODS OF PRODUCING INK TONERS AND INK COMPOSITIONS INCLUDING INK TONERS

BACKGROUND

Various techniques for electrostatic image transfer are known. One method includes the use of an intermediate transfer member. A liquid image, which includes a liquid carrier having ink particles dispersed therein, is transferred from a photoconductive surface of a photoconductive member or drum to a surface (e.g., a release layer or blanket) of the intermediate transfer member. The liquid image is attracted from the photoconductive surface to the surface of the intermediate transfer member. The liquid carrier is removed from the surface of the intermediate transfer member and the ink particles are compacted on the surface in the image configuration. Thereafter, the ink particles are transferred from the surface of the intermediate transfer member to a substrate in the image configuration by electrostatic attraction.

Modern liquid toner electrostatic imaging began with the invention of a new class of toners referred to as ElectroInk™. This type of toner is characterized by its toner particles being dispersed in a carrier liquid, where the toner particles include a core of a polymer with fibrous extensions extending from the core. When the toner particles are dispersed in the carrier liquid in a low concentration, the particles remain separate. When the toner develops an electrostatic image, the concentration of toner particles increases and the fibrous extensions interlock. A large number of patents and patent applications are directed toward this type of toner (e.g., U.S. Pat. Nos. 4,794,651; 4,842,974; 5,047,306; 5,407,307; 5,192,638; 5,208,130; 5,225,306; 5,264,312; 5,266,435; 5,286,593; 5,300,390; 5,346,796; 5,407,771; 5,554,476; 5,655,194; 5,792,584 and 5,5923,929 and PCT Patent publication WO/92/17823, the entire disclosures of all of which are incorporated herein by reference).

It has been discovered that this type of toner allows for high quality offset printing at high speed. This type of printing is described the following U.S. Pat. Nos. 4,678,317; 4,860,924; 4,980,259; 4,985,732; 5,028,964; 5,034,778; 5,047,808; 5,078,504; 5,117,263; 5,148,222; 5,157,238; 5,166,734; 5,208,130; 5,231,454; 5,255,058; 5,266,435; 5,268,687; 5,270,776; 5,276,492; 5,278,615; 5,280,326; 5,286,948; 5,289,238; 5,315,321; 5,335,054; 5,337,131; 5,376,491; 5,380,611; 5,426,491; 5,436,706; 5,497,222; 5,508,790; 5,527,652; 5,552,875; 5,555,185; 5,557,376; 5,558,970; and 5,570,193; the entire disclosures of which are incorporated herein by reference.

Color shifting pigments and colorants (e.g., special-effect pigments) have been used in numerous applications, ranging from automobile paints to anti-counterfeiting inks for security documents and currency. Such pigments and colorants exhibit the property of changing color upon variation of the angle of incident light, or as the viewing angle of observer is shifted. The primary method used to achieve such color shifting colorants is by dispersing small flakes, which are typically comprised of multiple layers of thin films having particular optical characteristics, throughout a medium such as paint or ink that may then be subsequently applied to the surface of an object.

The color shifting properties of the colorant can be controlled through proper design of the optical coatings or films used to form the flakes. Desired effects can be achieved through the variation of parameters such as thickness of the layers forming the flakes and the index of refraction of each layer. The changes in perceived color which occur for different viewing angles or angles of incident light are a result of a combination of selective absorption of the materials including the layers and wavelength dependent interference effects. The absorption characteristics of a material as well as interference phenomena are responsible for the basic color that is observed. The interference effects, which arise from the superposition of the light waves that have undergone multiple reflections and transmissions within the multilayered thin film structure, are responsible for the shifts in perceived color with different angles. Thus, use of the special-effect pigments requires that the layers of the special-effect pigments be intact in the ink formulation.

SUMMARY

Briefly described, embodiments of this disclosure includes methods of making ink toners for use in electrostatic imaging and ink compositions including the ink toners. One exemplary embodiment of a method of forming an ink toner, among others, includes: mixing a carrier liquid and a resin to form a slurry; grinding the slurry for about 1 to 5 hours at about 50° C. to 60° C. at about 500 to 800 revolutions per minute (RPM); reducing the grinding to about 25 to 150 RPM; adding a pigment to the slurry and grind until the pigment is absorbed in the slurry to form a slurry/pigment mixture, wherein the pigment is selected from optically variable pigments, thermochromic pigments, photochromic pigments, photo luminescent pigments, and combinations thereof; and grinding the slurry/pigment mixture at about 500 to 800 RPM for about 15 to 45 minutes at about 25° C. to 35° C. to form the ink toner.

BRIEF DESCRIPTION OF THE DRAWINGS

Many aspects of this disclosure can be better understood with reference to the following drawings. The components in the drawings are not necessarily to scale. Moreover, in the drawings, like reference numerals designate corresponding parts throughout the several views.

DETAILED DESCRIPTION

Figure 1:
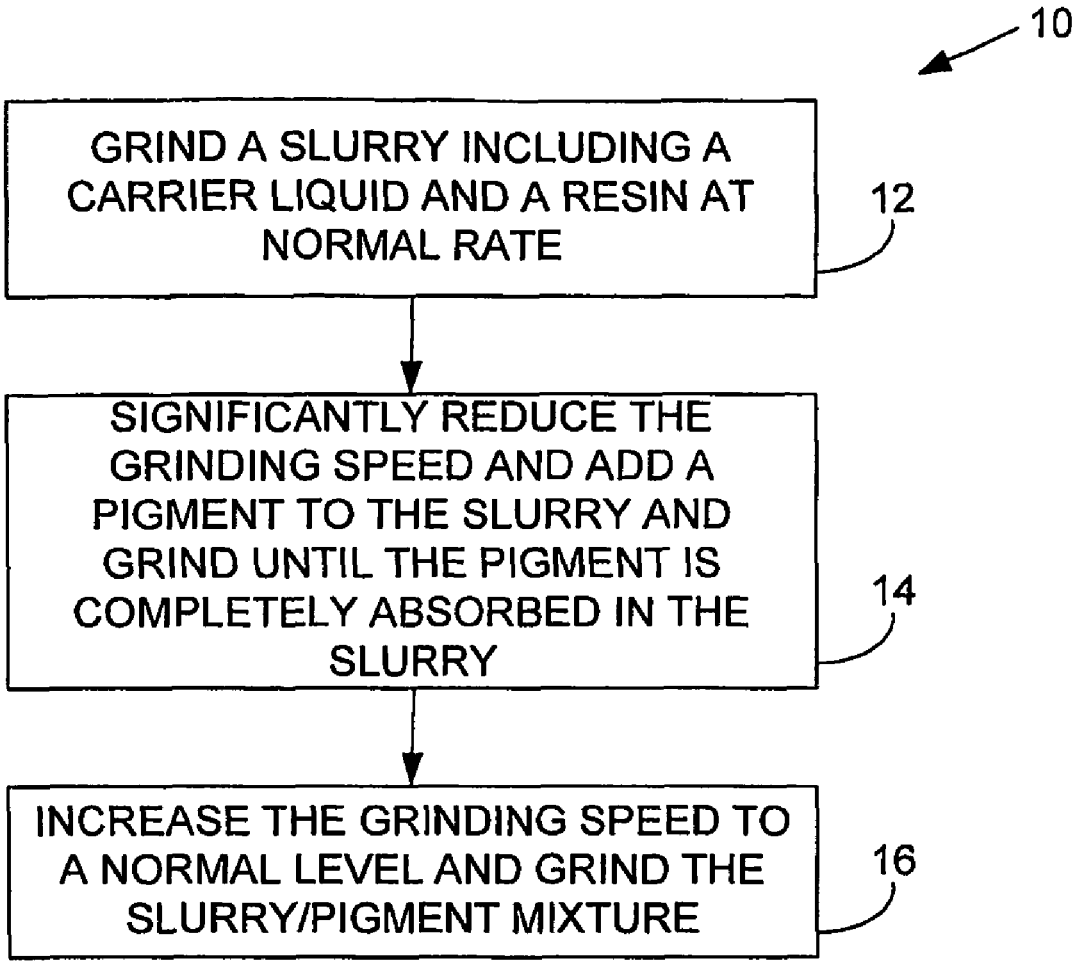
FIG. 1 illustrates a flow chart of an embodiment of a method for making optically variable ink toners.

Embodiments of the present disclosure will employ, unless otherwise indicated, techniques of synthetic organic chemistry, ink chemistry, media chemistry, printing chemistry, and the like, that are within the skill of the art. Such techniques are explained fully in the literature.

The following examples are put forth so as to provide those of ordinary skill in the art with a complete disclosure and description of how to perform the methods and use the compositions disclosed and claimed herein. Efforts have been made to ensure accuracy with respect to numbers (e.g., amounts, temperature, etc.) but some errors and deviations should be accounted for. Unless indicated otherwise, parts are parts by weight, temperature is in ° C., and pressure is at or near atmospheric. Standard temperature and pressure are defined as 20° C. and 1 atmosphere.

Before the embodiments of the present disclosure are described in detail, it is to be understood that, unless otherwise indicated, the present disclosure is not limited to particular materials, reagents, reaction materials, manufacturing processes, or the like, as such can vary. It is also to be understood that the terminology used herein is for purposes of describing particular embodiments only, and is not intended to be limiting. It is also possible in the present disclosure that steps can be executed in different sequence where this is logically possible.

It must be noted that, as used in the specification and the appended claims, the singular forms "a," "an," and "the" include plural referents unless the context clearly dictates otherwise. Thus, for example, reference to "a support" includes a plurality of supports. In this specification and in the claims that follow, reference will be made to a number of terms that shall be defined to have the following meanings unless a contrary intention is apparent.

Discussion

Embodiments of the present disclosure include methods of making ink toners and ink compositions for use in electrostatic imaging, where the ink toner includes a pigment that may not be able to be processed under normal conditions. The pigment can include, but is not limited to, optically variable pigments, thermochromic pigments, photochromic pigments, photo luminescent pigments, phosphorescent pigments, brittle pigments, crystalline pigments, or combinations thereof. Current methods of making optically variable ink toners for use in electrostatic imaging are not operable. Current methods destroy the pigments present in the ink toner. For example, one or more of the layers that make up optically variable pigments are destroyed during the grinding procedures used in the current methods. For reasons of clarity, reference will be made to optically variable pigments to describe embodiments of the present disclosure, but one or more of the pigments mentioned above can be substituted for (or combined with) the optically variable pigment in the embodiments described herein.

Current methods include mixing the optically variable pigment with a carrier liquid and a resin. The mixture is ground at about 700 revolutions per minute (RPM). The grinding causes one or more of the layers of the optically variable pigment to crack, flake off, or otherwise be damaged. The layers of the optically variable pigment provide the goniochromatic effect, metal effect, and/or interference effect for optically variable pigments.

Embodiments of the present disclosure include reducing the grinding speed (RPM) when the optically variable pigment is added to a pre-toner mixture. The reduced grinding speed allows the optically variable pigment to be absorbed into the pre-toner mixture. Then, once the optically variable pigment is absorbed into the pre-toner mixture, the grinding speed is increased and, ultimately a toner is produced that includes the optically variable pigment.

FIG. 1 illustrates a flow chart of an embodiment of a method 10 for making optically variable ink toners. Block 12 indicates that a slurry (also referred to as "pre-toner mixture") including a carrier liquid and a resin is ground at a normal speed, which is about 700 RPM. Other components such as, but not limited to, a charge adjuvant, organic/inorganic pigment, surface modifiers and additives, can be added to the slurry at this stage.

Block 14 indicates that the grinding speed is significantly reduced (e.g., about 25 to 150 RPM) and an optically variable pigment is added to the slurry and mixed until the optically variable pigment is completely absorbed into the slurry. Other components such as, but not limited to, a charge adjuvant, organic/inorganic pigment, surface modifiers, and additives, can be added to the slurry at this stage. Block 16 indicates that the grinding speed is increased to a normal level and the slurry/pigment is ground for a period of time and temperature. The final product, an optically variable ink toner, is removed after the slurry/pigment is ground.

Figure 2:
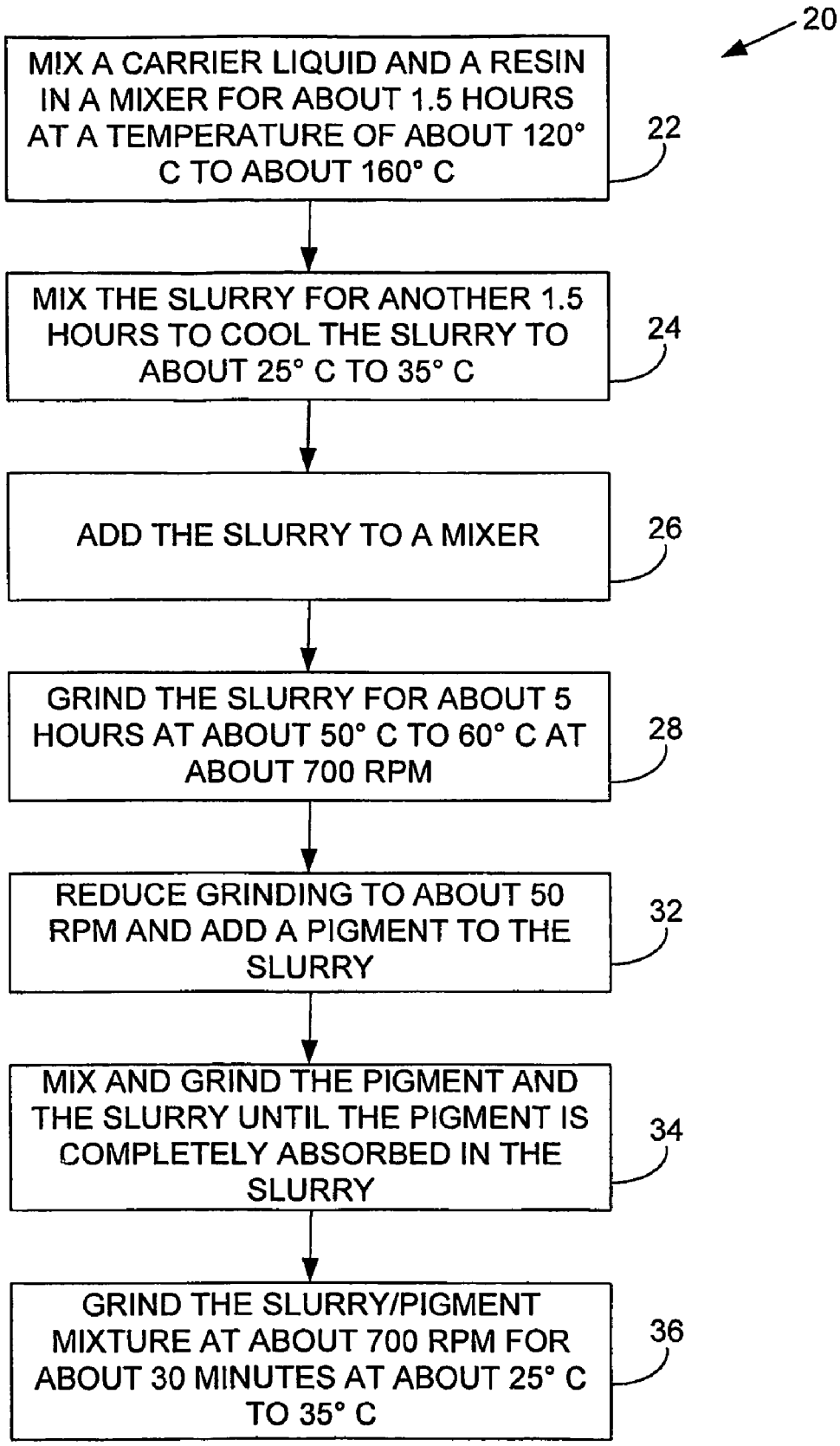
FIG. 2 illustrates a flow chart of an embodiment of a method for making optically variable ink toners.

FIG. 2 illustrates a flow chart of an embodiment of a method 20 for making optically variable ink toners. Block 22 indicates that a carrier liquid and a resin are mixed in a mixer (e.g., double planetary mixer and the like) for about 1 to 3 hours (or about 1.5 hours) at a temperature of about 120° C. to 160° C. Other components such as, but not limited to, a charge adjuvant, organic/inorganic pigment, surface modifiers, and additives, can be added to the slurry at this stage.

Block 24 indicates that the slurry is mixed for an additional 1 to 5 hours (or about 1.5 hours) to cool the slurry to about 25° C. to 35° C. Block 26 indicates that the slurry is added to a grinder (e.g., an attritor, a disk mill, a sand mill, an impeller attrition mill, a vibro-energy mill, or the like). Other components such as, but not limited to, a charge adjuvant, organic/inorganic pigment, surface modifiers, and additives, can be added to the slurry at this stage.

Block 28 indicates that the slurry is ground for about 3 to 8 hours (e.g., about 4 to 6 hours or about 5 hours) at about 50° C. to 60° C. at about 500 to 800 RPM (e.g., 600 to 800 RPM or about 700 RPM). Block 32 indicates that the grinding speed is reduced to about 25 to 150 RPM (e.g., about 25 to 100 RPM, about 40 to 60 RPM, or about 50 RPM) and then an optically variable pigment is added to the mixer. Other components such as, but not limited to, a charge adjuvant, organic/inorganic pigment, surface modifiers, and additives, can be added to the slurry at this stage.

Block 34 indicates that the slurry and pigment mixture is ground until the optically variable pigment is completely absorbed (e.g., the optically variable pigment is not observed) into the slurry, which is about 5 to 10 minutes. Block 36 indicates that the grinding is increased to about 500 to 800 RPM (e.g., 600 to 800 RPM or about 700 RPM) for about 10 to 40 minutes (about 30 minutes) at about 25° C. to 35° C. The optically variable ink toner is removed after the slurry/pigment is ground.

As mentioned above, the liquid carrier and the resin mixed to form a slurry. The carrier liquid can include, but is not limited to, an insulating, nonpolar liquid that is used as the medium for toner particles. The carrier liquid can include compounds that have a resistivity in excess of about $10^9$ ohm-cm and a dielectric constant below about 3.0. The carrier liquid can include, but is not limited to, hydrocarbons. The hydrocarbon can include, but is not limited to, an aliphatic hydrocarbon, an isomerized aliphatic hydrocarbon, branched chain aliphatic hydrocarbons, aromatic hydrocarbons, and combinations thereof.

Illustrative carrier liquids include, but are not limited to, aliphatic hydrocarbon, isoparaffinic compounds, paraffinic compounds, dearomatized hydrocarbon compounds, and the like. In particular, the carrier liquids can include, but are not limited to, Isopar-G™, Isopar-H™, Isopar-L™, Isopar-M™, Isopar-K™, Isopar-V™, Norpar 12™, Norpar 13™, Norpar 15™, Exxol D40™, Exxol D80™, Exxol D100™, Exxol D130™, and Exxol D140™ (each sold by EXXON CORPORATION); Teclen N-16™, Teclen N-20™, Teclen N-22™, Nisseki Naphthesol L™, Nisseki Naphthesol M™, Nisseki Naphthesol H™, #0 Solvent L™, #0 Solvent M™, #0 Solvent H™, Nisseki Isosol 300™, Nisseki Isosol 400™, AF-4™, AF-5™, AF-6™ and AF-7™ (each sold by NIPPON OIL CORPORATION); IP Solvent 1620™ and IP Solvent 2028™ (each sold by IDEMITSU PETROCHEMICAL CO., LTD.); Amsco OMS™ and Amsco 460™ (each sold by AMERICAN MINERAL SPIRITS CORP.); and electron, positron, new II, purogen HF (100% synthetic terpenes) (sold by ECOLINK).

The carrier liquid is about 20 to 95% by total weight of the slurry, 40 to 90% by total weight of the slurry, and 60 to 80% by total weight of the slurry.

The resin can include, but is not limited to, thermoplastic toner resins. In particular, the resin can include, but is not limited to, ethylene acid copolymers; ethylene acrylic acid copolymers; methacrylic acid copolymers; ethylene vinyl acetate copolymers; copolymers of ethylene (80 to 99.9%), acrylic, or methacrylic acid (20 to 0.1%)/alkyl (C1 to C5) ester of methacrylic or acrylic acid (0.1 to 20%); polyethylene; polystyrene; isotactic polypropylene (crystalline); ethylene ethyl acrylate; polyesters; polyvinyl toluene; polyamides; styrene/butadiene copolymers; epoxy resins; acrylic resins (e.g., copolymer of acrylic or methacrylic acid and at least one alkyl ester of acrylic or methacrylic acid wherein alkyl is from 1 to about 20 carbon atoms, like methyl methacrylate (50 to 90%)/methacryltic acid (0 to 20 percent/ethylhexylacrylate (10 to 50%)); ethylene-acrylate terpolymers: ethylene-acrylic esters-maleic anhydride (MAH) or glycidyl methacrylate (GMA) terpolymers; low molecular weight ethylene-acrylic acid ionomers and combinations thereof. In an embodiment, the toner can include the Nucrel family of toners (e.g., Nucrel 403™, Nucrel 407%, Nucrel 609HS™, Nucrel 908HS™, Nucrel 1202HC™, Nucrel 30707™, Nucrel 1214™, Nucrel 903™, Nucrel 3990™, Nucrel 910™, Nucrel 925™, Nucrel 699™, Nucrel 599™, Nucrel 960™, Nucrel RX 76™, Nucrel 2806™, Bynell 2002, Bynell 2014, and Bynell 2020 (sold by E.I. du PONT)), the Aclyn family of toners (e.g. Aclyn 201, Aclyn 246, Aclyn 285, and Aclyn 295), and the Lotader family of toners (e.g. Lotader 2210, Lotader, 3430, and Lotader 8200 (sold by Arkema)).

The resin is about 5% to 80% by total weight of the slurry, 10 to 60 by total weight of the slurry, and 15 to 40% by total weight of the slurry.

As mentioned above, the charge adjuvant, and optically variable pigment are mixed with the slurry in an attritor. The charge adjuvant can include, but is not limited to, barium petronate, calcium petronate, Co salts of naphthenic acid, Ca salts of naphthenic acid, Cu salts of naphthenic acid, Mn salts of naphthenic acid, Ni salts of naphthenic acid, Zn salts of naphthenic acid, Fe salts of naphthenic acid, Ba salts of stearic acid, Co salts of stearic acid, Pb salts of stearic acid, Zn salts of stearic acid, Al salts of stearic acid, Zn salts of stearic acid, Cu salts of stearic acid, Pb salts of stearic acid, Fe salts of stearic acid, divalent metal carboxylates and trivalent metal carboxylates (e.g., Al tristearate, Al octanoate, Li heptanoate, Fe stearate, Fe distearate, Ba stearate, Cr stearate, Mg octanoate, Ca stearate, Fe naphthenate, Zn naphthenate, Mn heptanoate, Zn heptanoate, Ba octanoate, Al octanoate, Co octanoate, Mn octanoate, and Zn octanoate), Co lineolates, Mn lineolates, Pb lineolates, Zn lineolates, Ca oleates, Co oleates, Zn palmirate, Ca resinates, Co resinates, Mn resinates, Pb resinates, Zn resinates, AB diblock copolymers of 2-ethylhexyl methacrylate-co-methacrylic acid calcium and ammonium salts, copolymers of an alkyl acrylamidoglycolate alkyl ether (e.g., methyl acrylamidoglycolate methyl ether-co-vinyl acetate), hydroxy bis(3,5-di-tert-butyl salicylic) aluminate monohydrate, and a mixture of hydroxy bis(3,5-di-tert-butyl salicylic) aluminate monohydrate. In an embodiment, the charge adjuvant is aluminum tristearate.

The charge adjuvant is about 0.1 to 5% by total weight of the solid, 0.5 to 4% by total weight of the solid, and 1 to 3% by total weight of the solid.

As mentioned above, the pigment can include pigments that can be damaged or made inoperable during normal toner making processes. The pigment can include, but is not limited to, optically variable pigments, thermochromic pigments, photochromic pigments, phosphorescent pigments, electroluminescent pigments, photoluminescent pigments, and combinations thereof.

The optically variable pigment or special-effect pigment can include, but is not limited to, metal effect pigments, interference pigments, luster, pigments, goniochromatic pigments, pearlescent pigments, and pigments that exhibits a change in color based on the angle of observation. By metal effect pigment is meant a pigment giving a metallic coloration and appearance. By interference pigment is meant a pigment giving an interference effect. The special-effect pigment is preferably a customary commercial metal-effect pigment (e.g., platelet-shaped iron oxide, aluminum flakes, Stapa-Alupaste™, and Standart™ each can be purchased from Eckart), special-effect pigments (e.g., Paliochrom™ which can be purchased from BASF), and pearl luster pigments (e.g., mica flake pigments coated with metal oxides, Iriodin™ each of which can be purchased from Merck KGaA, Darmstadt). The mica flake pigments coated with metal oxides are known, for example, from the German Patents and Patent Applications 14 67 468; 19 59 998; 20 09 566; 22 14 545; 22 15 191; 22 44 298; 23 13 331; 25 22 572; 31 37 808; 31 37 809; 31 51 343; 31 51 354; 31 51 355; 32 11 602; and 32 53 017, each of which are included herein by reference in their entireties.

The thermochromic pigments and/or photochromic pigments can include, but are not limited to, Thermochromic BT-31, Thermochromic VT-31, PhotoChromic BL-60S, and PhotoChromic VL-70S (trademarks owned and products sold by KELLY CHEMICAL CORP.); Covapearl Sparkling Silver 937 AS, Covapearl Silver 939 AS, Covapearl Sparkling Gold 238 AS, Covapearl Fire Red 333 AS, Covapearl Antique Silver 239 AS, Covapearl Bright 933 AS, Covapearl Satin 931 AS, Covapearl Antique 236 AS, Covapearl Pink 433 AS, Covapearl Red 339 AS, and Covapearl Blue 635 AS (trademarks owned and products sold by Adina Cosmetics); Aztec Gold=–305, Rutile sterling 103 and 108, Silk Pearl 173, Bronze Satin 310, Rutile Luster satin 121 and 130, Fine Gold Satin 201, Wine Red Satin 524, Wine Red Satin 224, Bronze Satin 530, Fine Gold Satin 201, Platinum Pearl 205, and Special Flash Pearl 183 (trademarks owned and products sold by Zhejiang Aoke pearlescent Pigment Co., Ltd); KTZ Roussillon-TTB2, KTZ Aruban Coral-I2, KTZ Aruban Cora, KTZ Shimmer White, KTZ Stellar White 11S2, and KTZ Jaipur Sunset (trademarks owned and products sold by Kobo Products Inc.); XYMARA PEARL 103 XYMARA™ Marker Green SF1A, XYMARA™ Marker Ice Blue SF2A, XYMARA™ Marker Turquoise LF1A (sold by CIBA); DECO IRIS-GLITTER 2701-322-11hex RAINBOW (sold by SiLi—SIGMUND LINDER GmbH); VA-516 Yellow and VA-515 Yellow Orange (sold by Vicome Corp.); KW 421 Magic yellow, KW 163 Shimmer Pearl, KW 289 Glitter Blue, KW 534 Shimmer Wine Red, KW 400B Luster Pure Blue, and KW 483 Silky Purple; (trademarks owned and products sold by WENZHOU KUNWEI PEARL PIGMENTS CO.); StarLight HM72, StarLight SM26, and StarLight FL500 (trademarks owned and products sold by SHEPHERD); 933 AS, 339AS, 238AS, 939AS, 635AS, 931AS, 239AS, 333AS, 937AS, 433AS, and 236AS (trademarks owned and products sold by SENSIENT COSMETIC TECHNOLOGIES); Mearlin Hi-Lite Sparkle Gold, Mearlin Hi-Lite Sparkle Violet, Mearlin Hi-Lite Sparkle Green, Mearlin Firemist Pearl, Mearlin Firemist Violet, and Mearlin Firemist Green (trademarks owned and products sold by ENGELHARD); Deco Iris-Glitter 2701-322-11hex, Rainbow Polyester-Glitter 2501-81E-11hex, Yellow Deco-Polyester Glitter 2701-67-11 hex, Multi Deco Hologramm 2701-59A-11 hex, Copper Deco-Iris Glitter 2701-300FM-11hex, Way Too Pink Alu-Glitter 2101-54-1sq, Royal Blue Alu-Glitter 2110-50-1sq, Bright Silver Alu-Glitter 2101-43-1sq, and Rich Red Gold (trademarks owned and products sold by SIGMUND LINDER GmbH); and those shown in Table 1 below (trademarks owned and products sold by Clariant).

TABLE 1

| | | | |
|---|---|---|---|
| Gold Luster | | | |
| Satin Gold 302 | Sunny Gold 351 | Solar Gold 305 | Royal Gold 303 |
| Satin Green 302 | Sunny Green 351 | Solar Green 305 | Royal Green 303 |
| Satin Orange 302 | Sunny Orange 351 | Solar Orange 305 | Royal Orange 303 |
| Satin Black 302 | Sunny Black 351 | Solar Black 305 | Royal Black 303 |
| White Luster | | | |
| Satin Gold 302 | Sunny Gold 351 | Solar Gold 305 | Royal Gold 303 |
| Satin Green 302 | Sunny Green 351 | Solar Green 305 | Royal Green 303 |
| Satin Orange 302 | Sunny Orange 351 | Solar Orange 305 | Royal Orange 303 |
| Satin Black 302 | Sunny Black 351 | Solar Black 305 | Royal Black 303 |
| Metal Luster | | | |
| Yellow Satin 520 | Rose Gold Satin 520 | CoR-PP18er Satin 522 | Red Satin 524 |
| Gold Satin 520 | Bronze Satin 520 | Brown Satin 522 | Volcanic Satin 524 |
| Silver A 123 | Silver B 123 | Silver C 123 | Silver D 123 |
| Sterling Silver A 103 | Sterling Silver B 103 | Sterling Silver C 103 | Sterling Silver D 103 |
| Classic | | | |
| White Classic 201 | White Classic 231 | White Classic 211 | White Classic 221 |
| Orange Classic 201 | Yellow Classic 231 | Yellow Classic 211 | Red Classic 221 |
| Green Classic 201 | Blue Classic 231 | Blue Classic 211 | Green Classic 221 |
| Gold Classic 201 | Green Classic 231 | Red Classic 211 | Blue Classic 221 |
| FLASH | | | |
| White Flash 249 | White Flash 299 | White Flash 259 | White Flash 289 |
| Yellow Flash 249 | Green Flash 299 | Red Flash 259 | Blue Flash 289 |
| Green Flash 249 | Blue Flash 299 | Yellow Flash 259 | Red Flash 289 |
| Black Flash 249 | Black Flash 299 | Black Flash 259 | Black Flash 289 |
| MULTI INTERFERENCE | | | |
| White Multi T20 | Blue Multi T20 | Blue Flash S 105 | Blue Classic S 105 |
| Yellow Multi T20 | Blue/Green Multi T20 | Green Flash S 105 | Green Classic S 105 |
| Red Multi T20 | Green Multi T20 | Yellow Flash S 105 | Red Classic S 105 |
| Pink Multi T20 | Black Multi T20 | Red Flash S 105 | Gold Classic S 105 |
| GLITTER | | | |
| Shimmer Pearl 163 | Gold Glitter 355 | Red Shimmer 163 | Green Flash 153 |
| Gold 43E | Rose Gold 7E | Orange Gold 8E | Cherrywood 41E |
| Purple 13E | Emerald 20E | Peacock 16E | Black Fox 32E |
| Bright Silver 140 | Bright Silver 160 | Bright Silver 100 | Sparkle Pearl 183 |
| SPARKLE | | | |
| White Star 105 | Yellow Star 105 | Red Star 500 | Blue Star 500 |
| Gold Star 105 | Magenta Star 105 | Orange Star 500 | Purple Star 500 |
| CoR-PP18er Star 105 | Green Star 105 | Yellow Star 500 | Magenta Star 500 |
| Volcanic Star 105 | Black Star 105 | Green Star 500 | Black Star 500 |

The photo luminescent can include, but are not limited to, Green VGS3-FAP (trademarks owned and products sold by VISIOGLOW); UPO-9D, UPO-9C, UPO-9E, UPB7E, RC-8C, and ROR-8C (trademarks owned and products sold by HANGZHOU UNION PIGMENT Co.), Phosphor H10 (trademarks owned and products sold by H13Cleveland Pigment & Color), and Luminova GLL-300FFS (trademarks owned and products sold by NEMOTO PORTUGAL). The electroluminescent pigments can include, but are not limited to, Glacierglo GG25X1009 Blue/Green (trademarks owned and products sold by OSRAM SYLVANIA).

The optically variable pigment is about 5% to 80% by total weight of the solid, about 10 to 70% by total weight of the solid, and 30 to 60% by total weight of the solid.

In an embodiment the optically variable ink toner, the final product is about 0.85 to 56.4 weight % of resin, about 0.25 to 48 weight % of the optically variable pigment, about 0.05 to 1.8 weight percent of the charge adjuvant, and about 40 to 95 weight % of liquid carrier (e.g., the amount of liquid carrier is adjusted to modify the viscosity of the toner).

In an embodiment the optically variable ink toner, the final product is about 47 to 69 weight % of resin, about 30 to 60 weight % of the optically variable pigment, about 1 to 3 weight percent of the charge adjuvant, and an amount of liquid carrier to modify the viscosity of the toner to the appropriate viscosity.

It should also be noted that embodiments of this disclosure provide for ink toners that may be used for security applications such as optically variable inks, specifically activated under ultra violet (UV) radiation inks (e.g., visible if exposed to specific UV wave length), phosphorescent inks, "double-security effect" inks (e.g., phosphorescent in the dark (glow in the dark) and visible under UV radiation, electroluminescent inks and thermo/photo inks).

While embodiments of the present disclosure are described in connection with Example 1 and the corresponding text and figures, there is no intent to limit the disclosure to the embodiments in these descriptions. On the contrary, the intent is to cover all alternatives, modifications, and equivalents included within the spirit and scope of embodiments of the present disclosure.

Example 1

In an illustrative embodiment, a toner including an optically variable pigment may be prepared by preparing a mixture of a carrier liquid such as Isopar-L™ (about 60%-85%, by total weight), a resin such as Nucrel™ 699 (about 15%-40%, by total weight). The ingredients are mixed in a double planetary mixer, for example a Ross mixer, for about 1.5 hours at a temperature between about 120° C. to about 160° C. to produce a slurry of the carrier and polymer particles plasticized by solvation of the liquid carrier. The mixing is then continued for another 1.5 hours while the mixture cools down to room temperature. The slurry (about 50%-90%, by total weight of solids) is then added to a 750 ml attritor (e.g., a Union Process™ MODEL 01-HD ATTRITOR) together with a charge adjuvant like aluminum tristearate (about 1%-5%, by total weight of solids). Isopar-L™ can be added to adjust the viscosity of the slurry. The slurry is ground for 5 hours at about 50° C.-60° C. at about 700 RPM. After this the RPM is lowered to about 50 RPM and a pigment such as Iriodin 7235™ (about 30%-50%, by total weight of solids) is added to the slurry. The slurry mixed for several minutes until the pigment is completely absorbed in the slurry. After absorption the RPM is raised to about 700 and cooling begins immediately to bring the temperature to about 25° C.-35° C. The slurry is left to mix for about 30 minutes and then the attritor is stopped and toner including the optically variable pigment is removed.

Example 2

In an illustrative embodiment, a toner including an optically variable pigment may be prepared by preparing a mixture of a carrier liquid such as Isopar-L™ (about 60%-85%, by total weight), a resin such as Bynell 2020 (about 15%-40%, by total weight). The ingredients are mixed in a double planetary mixer, for example a Ross mixer, for about 1.5 hours at a temperature between about 120° C. to about 160° C. to produce a slurry of the carrier and polymer particles plasticized by solvation of the liquid carrier. The mixing is then continued for another 1.5 hours while the mixture cools down to room temperature. The slurry (about 50%-90%, by total weight of solids) is then added to a 750 ml attritor (e.g., a Union Process™ MODEL 01-HD ATTRITOR) together with a charge adjuvant like aluminum tristearate (about 1%-5%, by total weight of solids). Isopar-L™ can be added to adjust the viscosity of the slurry. The slurry is ground for 5 hours at about 50° C.-60° C. at about 700 RPM. After this the RPM is lowered to about 50 RPM and a pigment such as Thermochromic BT-31™ (about 30%-50%, by total weight of solids) is added to the slurry. The slurry mixed for several minutes until the pigment is completely absorbed in the slurry. After absorption the RPM is raised to about 700 and cooling begins immediately to bring the temperature to about 25° C.-35° C. The slurry is left to mix for about 30 minutes and then the attritor is stopped and toner including the thermochromic pigment is removed.

Example 3

In an illustrative embodiment, a toner including an optically variable pigment may be prepared by preparing a mixture of a carrier liquid such as Isopar-L™ (about 60%-85%, by total weight), a resin such as Nucrel™ 903 (about 15%-40%, by total weight). The ingredients are mixed in a double planetary mixer, for example a Ross mixer, for about 1.5 hours at a temperature between about 120° C. to about 160° C. to produce a slurry of the carrier and polymer particles plasticized by solvation of the liquid carrier. The mixing is then continued for another 1.5 hours while the mixture cools down to room temperature. The slurry (about 50%-90%, by total weight of solids) is then added to a 750 ml attritor (e.g., a Union Process™ MODEL 01-HD ATTRITOR) together with a charge adjuvant like aluminum tristearate (about 1%-5%, by total weight of solids). Isopar-L™ can be added to adjust the viscosity of the slurry. The slurry is ground for 5 hours at about 50° C.-60° C. at about 700 RPM. After this the RPM is lowered to about 50 RPM and a pigment such as PhotoChromic VL-70S™ (about 30%-50%, by total weight of solids) is added to the slurry. The slurry mixed for several minutes until the pigment is completely absorbed in the slurry. After absorption the RPM is raised to about 700 and cooling begins immediately to bring the temperature to about 25° C.-35° C. The slurry is left to mix for about 30 minutes and then the attritor is stopped and toner including the PhotoChromic pigment is removed.

Example 4

In an illustrative embodiment, a toner including an optically variable pigment may be prepared by preparing a mixture of a carrier liquid such as Isopar-L™ (about 60%-85%, by total weight), a resin such as Bynel 2020 (about 12%-32%, by total weight), and Nucrel™ 699 (about 3%-8%, by total weight). The ingredients are mixed in a double planetary mixer, for example a Ross mixer, for about 1.5 hours at a temperature between about 120° C. to about 160° C. to produce a slurry of the carrier and polymer particles plasticized by solvation of the liquid carrier. The mixing is then continued for another 1.5 hours while the mixture cools down to room temperature. The slurry (about 50%-90%, by total weight of solids) is then added to a 750 ml attritor (e.g., a Union Process™ MODEL 01-HD ATTRITOR) together with a charge adjuvant like aluminum tristearate (about 1%-5%, by total weight of solids). Isopar-L™ can be added to adjust the viscosity of the slurry. The slurry is ground for 5 hours at about 50° C.-60° C. at about 700 RPM. After this the RPM is lowered to about 50 RPM and a pigment such as Covapearl Sparkling Silver 937 AS™ (about 30%-50%, by total weight of solids) is added to the slurry. The slurry mixed for several minutes until the pigment is completely absorbed in the slurry. After absorption the RPM is raised to about 700 and cooling begins immediately to bring the temperature to about 25° C.-35° C. The slurry is left to mix for about 30 minutes and then the attritor is stopped and toner including the optically variable pigment is removed.

Example 5

In an illustrative embodiment, a toner including a phosphorescent pigment may be prepared by preparing a mixture of a carrier liquid such as Isopar-L™ (about 60%-85%, by total weight), a resin such as Aclyn 295 (about 12%-32%, by total weight). The ingredients are mixed in a double planetary mixer, for example a Ross mixer, for about 1.5 hours at a temperature between about 120° C. to about 160° C. to produce a slurry of the carrier and polymer particles plasticized by solvation of the liquid carrier. The mixing is then continued for another 1.5 hours while the mixture cools down to room temperature. The slurry (about 50%-90%, by total weight of solids) is then added to a 750 ml attritor (e.g., a Union Process™ MODEL 01-HD ATTRITOR) together with a charge adjuvant like aluminum tristearate (about 1%-5%, by total weight of solids). Isopar-L™ can be added to adjust the viscosity of the slurry. The slurry is ground for 5 hours at about 50° C.-60° C. at about 700 RPM. After this the RPM is lowered to about 50 RPM and a pigment such as Phosphor H10™ (about 30%-50%, by total weight of solids) is added to the slurry. The slurry mixed for several minutes until the pigment is completely absorbed in the slurry. After absorption the RPM is raised to about 700 and cooling begins immediately to bring the temperature to about 25° C.-35° C. The slurry is left to mix for about 30 minutes and then the attritor is stopped and toner including the phosphorescent pigment is removed. This produces a double-security ink that glows in the dark (phosphorescent effect) and is luminescent as a green color in the visible range under UV light.

Example 6

In an illustrative embodiment, a toner including a phosphorescent pigment may be prepared by preparing a mixture of a carrier liquid such as Isopar-L™ (about 60%-85%, by total weight), a resin such as Nucrel 699 (about 12%-32%, by total weight). The ingredients are mixed in a double planetary mixer, for example a Ross mixer, for about 1.5 hours at a temperature between about 120° C. to about 160° C. to produce a slurry of the carrier and polymer particles plasticized by solvation of the liquid carrier. The mixing is then continued for another 1.5 hours while the mixture cools down to room temperature. The slurry (about 50%-90%, by total weight of solids) is then added to a 750 ml attritor (e.g., a Union Process™ MODEL 01-HD ATTRITOR) together with a charge adjuvant like aluminum tristearate (about 1%-5%, by total weight of solids). Isopar-L™ can be added to adjust the viscosity of the slurry. The slurry is ground for 5 hours at about 50° C.-60° C. at about 700 RPM. After this the RPM is lowered to about 50 RPM and a pigment such as Phosphorescent pigment Luminova GLL-300 FFS™ (about 30%-50%, by total weight of solids) is added to the slurry. The slurry mixed for several minutes until the pigment is completely absorbed in the slurry. After absorption the RPM is raised to about 700 and cooling begins immediately to bring the temperature to about 25° C.-35° C. The slurry is left to mix for about 30 minutes and then the attritor is stopped and toner including the phosphorescent pigment is removed. This produces a double security ink that glows in the dark (phosphorescent effect) and is luminescent in a green color in the visible range under UV light.

Example 7

In an illustrative embodiment, a toner including a phosphorescent pigment may be prepared by preparing a mixture of a carrier liquid such as Isopar-L™ (about 60%-85%, by total weight), a resin such as Lotader 8200 (about 12%-32%, by total weight). The ingredients are mixed in a double planetary mixer, for example a Ross mixer, for about 1.5 hours at a temperature between about 120° C. to about 160° C. to produce a slurry of the carrier and polymer particles plasticized by solvation of the liquid carrier. The mixing is then continued for another 1.5 hours while the mixture cools down to room temperature. The slurry (about 50%-90%, by total weight of solids) is then added to a 750 ml attritor (e.g., a Union Process™ MODEL 01-HD ATTRITOR) together with a charge adjuvant like aluminum tristearate (about 1%-5%, by total weight of solids). Isopar-L™ can be added to adjust the viscosity of the slurry. The slurry is ground for 5 hours at about 50° C.-60° C. at about 700 RPM. After this the RPM is lowered to about 50 RPM and a pigment such as Glacierglo GG25X1009 Blue/Green™ (about 30%-50%, by total weight of solids) is added to the slurry. The slurry mixed for several minutes until the pigment is completely absorbed in the slurry. After absorption the RPM is raised to about 700 and cooling begins immediately to bring the temperature to about 25° C.-35° C. The slurry is left to mix for about 30 minutes and then the attritor is stopped and toner including the phosphorescent pigment is removed. This produces an electroluminescent ink.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range.

Many variations and modifications may be made to the above-described embodiments. All such modifications and variations are intended to be included herein within the scope of this disclosure and protected by the following claims.

At least the following is claimed:

1. A method of forming an ink toner, comprising:

mixing a carrier liquid and a resin to form a slurry;

grinding the slurry for about 1 to 5 hours at about 50° C. to 60° C. at about 500 to 800 revolutions per minute (RPM);

reducing the grinding to a speed of about 25 to 150 RPM;

adding a pigment to the slurry and grinding at the reduced speed for about 5 minutes to about 10 minutes until the pigment is absorbed in the slurry to form a slurry/pigment mixture, wherein the pigment is selected from optically variable pigments, thermochromic pigments, photochromic pigments, photo luminescent pigments, phosphorescent pigments, electroluminescent pigments, and combinations thereof;

increasing the grinding speed to about 500 to 800 RPM; and grinding the slurry/pigment mixture at the increased grinding speed for about 15 to 45 minutes at about 25° C. to 35° C. to form the ink toner.

2. The method of claim 1, wherein the carrier liquid is selected from a compound having the following characteristics: a resistivity in excess of about $10^9$ ohm-cm and a dielectric constant below about 3.0.

3. The method of claim 1, wherein the resin comprises a thermoplastic toner resin.

4. The method of claim 1, wherein the pigment is the optically variable pigment.

5. The method of claim 1, wherein the pigment is the thermochromic pigment.

6. The method of claim 1, wherein the pigment is the photochromic pigment.

7. The method of claim 1, wherein the pigment is the photoluminescent pigment.

8. The method of claim 1, wherein reducing the grinding comprises:

reducing the grinding to about 25 to 100 RPM.

9. The method of claim 1, wherein reducing the grinding comprises:

reducing the grinding to about 40 to 60 RPM.

10. The method of claim 1, wherein grinding the slurry/pigment mixture comprises:

grinding the slurry/pigment mixture at about 500 to 750 RPM for about 25 to 35 minutes at about 25° C. to 35° C. to form the ink toner.

11. The method of claim 1, wherein grinding the slurry further comprises:

adding a charge adjuvant to the slurry.

12. The method of claim 1, wherein the grinding is performed in an attritor.

13. The method of claim 1, wherein mixing the carrier liquid and the resin to form the slurry further comprises:

mixing the carrier liquid and the resin for about 1 to 2 hours at about 120° C. to 160° C.; and mixing the carrier liquid and the resin for about 1 to 2 hours to cool the mixture to about 25° C. to 35° C.

14. The method of claim 1, wherein the pigment is the phosphorescent pigment.

15. The method of claim 1, wherein the pigment is the electroluminescent pigment.

16. The method of claim 1, wherein the ink toner is phosphorescent and luminescent when exposed to ultra violet radiation.

17. The method of claim 1, wherein the ink toner is luminescent when exposed to a specific ultra violet wavelength radiation.

* * * * *